US009079204B1

(12) United States Patent
Hattenbrun

(10) Patent No.: US 9,079,204 B1
(45) Date of Patent: Jul. 14, 2015

(54) SHOWERHEAD CLEANING ADAPTER

(71) Applicant: Troy C. Hattenbrun, Spring Hill, FL (US)

(72) Inventor: Troy C. Hattenbrun, Spring Hill, FL (US)

( * ) Notice: Subject to any disclaimer, the term of this patent is extended or adjusted under 35 U.S.C. 154(b) by 239 days.

(21) Appl. No.: 13/914,352

(22) Filed: Jun. 10, 2013

(51) Int. Cl.
*B05B 15/02* (2006.01)
*B05B 7/04* (2006.01)
*B05B 7/12* (2006.01)

(52) U.S. Cl.
CPC ..... *B05B 15/025* (2013.01); *B05B 7/0408* (2013.01); *B05B 7/1209* (2013.01); *B05B 15/02* (2013.01)

(58) Field of Classification Search
CPC .. B05B 15/02; B05B 15/025; B05B 15/0258; B05B 15/0266; B05B 7/0408; B05B 7/1209
See application file for complete search history.

(56) References Cited

U.S. PATENT DOCUMENTS

| | | | | |
|---|---|---|---|---|
| 3,713,585 | A * | 1/1973 | Conklin | 239/307 |
| 3,964,686 | A * | 6/1976 | Lopez | 239/74 |
| 4,047,541 | A * | 9/1977 | Mercier et al. | 137/564.5 |
| 4,121,773 | A | 10/1978 | Headen et al. | |
| 4,840,311 | A | 6/1989 | Shamblin | |
| 5,071,070 | A * | 12/1991 | Hardy | 239/311 |
| 5,970,995 | A | 10/1999 | Schy | |
| 7,093,775 | B1 * | 8/2006 | Bingham | 239/302 |
| 8,800,891 | B2 * | 8/2014 | Cheng | 239/313 |

* cited by examiner

*Primary Examiner* — Ryan Reis
(74) *Attorney, Agent, or Firm* — Crossley Patent Law

(57) ABSTRACT

A showerhead cleaning adapter that includes a pipe member having a male end and a female end disposed for positioning between an extant showerhead and an extant manifold, said pipe member including a flow controlling side inlet pipe valve disposed to releasably interconnect a cartridge therein, said cartridge discharging cleaning solution into said showerhead when attached to, and depressed within, an interconnect portion of the side inlet pipe valve, wherein cleaning solution is selectively releasable to clean and disinfect an extant showerhead interior.

9 Claims, 3 Drawing Sheets

SHOWERHEAD CLEANING ADAPTER

BACKGROUND OF THE INVENTION

Various types of showerhead cleaning apparatuses are known in the prior art. However, what is needed is a showerhead cleaning adapter that includes a pipe member having a male end and a female end disposed for positioning between an extant showerhead and an extant manifold, said pipe member including a flow controlling side inlet pipe valve disposed to releasably interconnect a cartridge therein, said cartridge discharging cleaning solution into said showerhead when attached to, and depressed within, an interconnect portion of the side inlet pipe valve, wherein cleaning solution is selectively releasable to clean and disinfect an extant showerhead interior.

FIELD OF THE INVENTION

The present invention relates to a showerhead cleaning adapter, and more particularly, to a showerhead cleaning adapter that includes a pipe member having a male end and a female end disposed for positioning between an extant showerhead and an extant manifold, said pipe member including a flow controlling side inlet pipe valve disposed to releasably interconnect a cartridge therein, said cartridge discharging cleaning solution into said showerhead when attached to, and depressed within, an interconnect portion of the side inlet pipe valve, wherein cleaning solution is selectively releasable to clean and disinfect an extant showerhead interior.

SUMMARY OF THE INVENTION

The general purpose of the showerhead cleaning adapter, described subsequently in greater detail, is to provide a showerhead cleaning adapter which has many novel features that result in a showerhead cleaning adapter which is not anticipated, rendered obvious, suggested, or even implied by prior art, either alone or in combination thereof.

Showerheads are often problematic to clean. Typically, a showerhead is disconnected from the shower manifold and cleaned separately. Detaching the showerhead can be cumbersome; but in order to access the interior to remove scaling caused by calcination and other mineral deposits, and to clean out potential pathogens as case may be, detachment is necessary with most showers in use today.

What is needed is a means to clean a showerhead interior without detachment of the showerhead; a means to provide an expedient, efficient discharge of cleaning solution through the showerhead interior whenever desired.

It should be noted that the term "cleaning solution" as used herein and throughout this application is taken to include detergents, disinfectants, and other liquid phase materials able to cleanse and disinfect a showerhead, including chemical agents capable of rapid removal of lime scale and other mineral deposits precipitated in a particular showerhead.

The present showerhead cleaning adapter, then, has been devised to enable depression of an attachable cartridge mounted to a side inlet pipe valve, whereby cleaning solution is dischargeable from the cartridge through a central pipe and into a showerhead interior without the showerhead being detached from the manifold.

The present showerhead cleaning adapter therefore includes a pipe member having a male end and a female end. The male end is contemplated for attachment with an extant showerhead and the female end for attachment with an extant manifold whereby the pipe member is readily positional between said manifold and said showerhead.

The pipe member includes a side inlet pipe valve disposed projecting therefrom. The side inlet pipe valve is configured for interconnection with a prefabricated cartridge containing cleaning solution. The cartridge may be pressurized so that the cleaning solution is forcibly discharged when the cartridge is depressed in the manner described subsequently. Alternately, the cartridge may operate under the influence of gravity.

The side inlet pipe valve includes an interconnect portion disposed to threadably connect to a first end of the cartridge. The interconnect portion is compressibly mounted in the side inlet pipe valve, there moveable between an uncompressed position and a compressed position. A spring member is disposed within the side inlet pipe valve compressibly engaged against the interconnect portion whereby said interconnect portion is returned to the uncompressed position subsequent release when compressed.

A central pipe is disposed within the side inlet pipe valve. The central pipe maintains a continuous cavity through the side inlet pipe valve, through the pipe member, and through to the shower head. The central pipe extends into the interconnect portion, whereby the interconnect portion is moveable relative the central pipe. Thus, when the cartridge is attached to the interconnect portion, and the cartridge depressed, the interconnect portion is compressed and the first end of the cartridge is moved towards the central pipe. The central pipe is thus effectively extended to breech the first end, whereby cleaning solution within the cartridge is discharged into the central pipe, and thereby into the showerhead interior.

When the cartridge is released, the spring member forcibly returns the interconnect portion to the uncompressed position, the first end of the cartridge is moved away from the central pipe, and said central pipe thereby effectively retracted from the cartridge first end. When the central pipe is effectively retracted from the cartridge first end, the first end ceases to be breeched and cleaning solution thereby ceases to be discharged from said cartridge.

A washer is disposed within the side inlet pipe valve to maintain sealed attachment between the cartridge and the interconnect portion.

For ease of use, and to provide a convenient point of leverage for effecting the same, a pair of thumb supports is disposed upon the side inlet pipe valve. Each of the pair of thumb supports is disposed appropriate for engagement by each of a user's thumbs when singlehandedly depressing the cartridge with either hand.

It should be readily recognized that additional cartridges, containing a variety of cleaning solutions, are contemplated as part of this invention, and that a user could happily choose a particular cartridge for a particular job at hand. For example, a showerhead beset with calcination from hard water can choose an acidic solution, or some other solution suited to removal of said precipitate, a solution that may be provided in a particular cartridge. Whereas another consumer may opt for a disinfecting cartridge that purges potential pathogens from the showerhead. Such cartridges may be presented in a series of strengths and potencies, configured for a particular job, as desired.

Thus has been broadly outlined the more important features of the present showerhead cleaning adapter so that the detailed description thereof that follows may be better understood and in order that the present contribution to the art may be better appreciated.

Objects of the present showerhead cleaning adapter, along with various novel features that characterize the invention are particularly pointed out in the claims forming a part of this disclosure. For better understanding of the showerhead cleaning adapter, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 2:
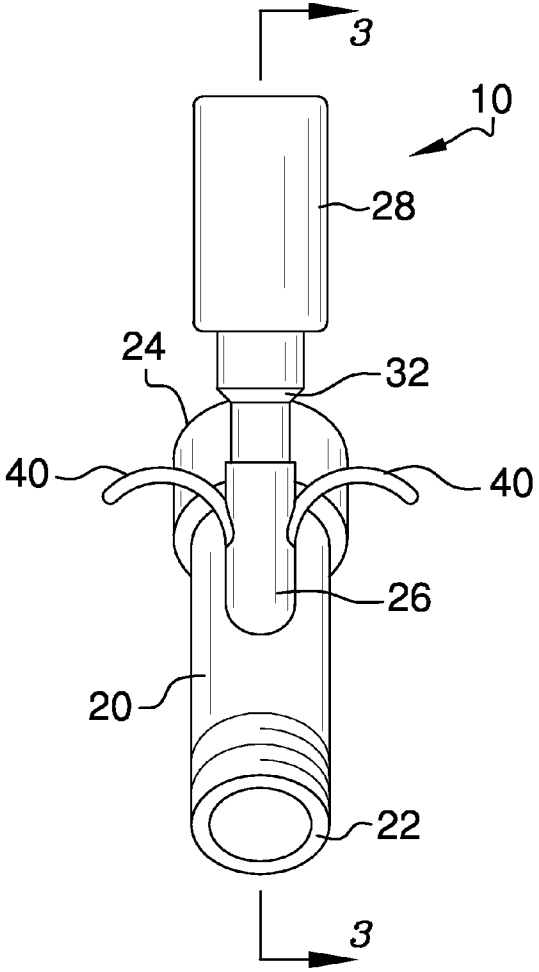
FIG. 2 is a forward view.
Figure 1:
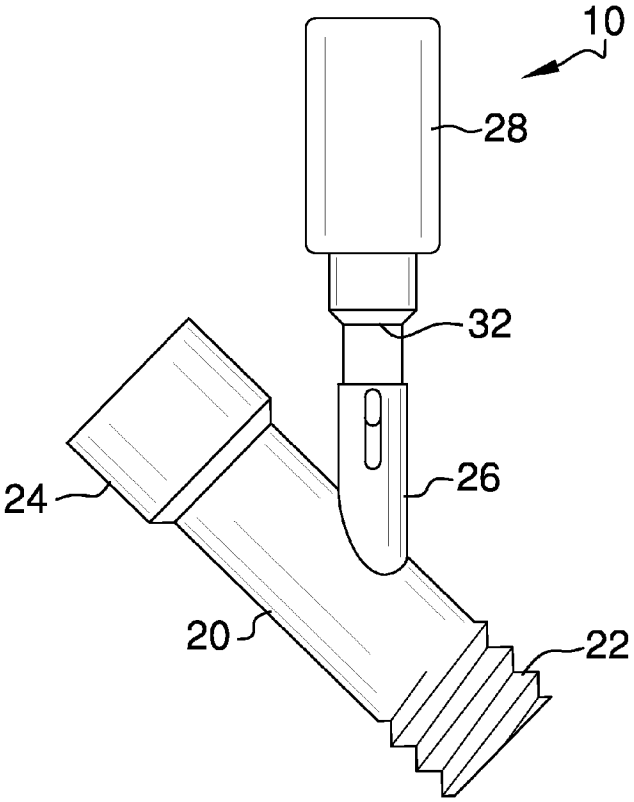
FIG. 1 is a side view.

With reference now to the drawings, and in particular FIGS. 1 through 5 thereof, example of the instant showerhead cleaning adapter employing the principles and concepts of the present showerhead cleaning adapter and generally designated by the reference number 10 will be described.

Referring to FIGS. 1 through 5 a preferred embodiment of the present showerhead cleaning adapter 10 is illustrated.

The present device 10 has been enabled to provide an efficient and expedient means for cleaning an extant showerhead by discharging cleaning solution from a prefabricated cartridge attached to a side inlet pipe valve through a pipe member and into said showerhead, whereby said showerhead is readily cleaned and disinfected thereby.

The showerhead cleaning adapter 10, therefore, includes a pipe member 20 having a male end 22 disposed for interconnection with an extant showerhead 70 and a female end 24 disposed for interconnection with an extant shower pipe manifold 72. The pipe member 20 is thus positional installed between an extant showerhead 70 and an extant manifold 72.

The pipe member 20 includes a side inlet pipe valve 26 disposed to threadably interconnect with a cartridge 28 containing cleaning solution 74. The cartridge 28 is thereat dischargeable through the side inlet pipe valve 26, and into the showerhead 70, when said cartridge 28 is depressed into the side inlet pipe valve 26, as will be described subsequently.

The cartridge 28 includes a threaded first end 30 disposed to threadably interconnect with an interconnect portion 32 disposed upon the side inlet pipe valve 26. The interconnect potion 32 is compressible whereby the cartridge 28, when attached to the interconnect portion 32, is depressible. A spring member 34 is compressibly engaged against the interconnect portion 32 within the side inlet pipe valve 26, said spring member 34 forcing said interconnect portion 32 back to an uncompressed position when said interconnect portion 32 is released subsequent depression of the cartridge 28. A washer 36 is disposed to maintain a sealed connection between the cartridge 28 and the interconnect portion 32 when the interconnect portion 32 is in the uncompressed position.

The side inlet pipe valve 26 includes a central pipe 38 disposed centrally therein. The central pipe 38 maintains a continuous cavity through to the pipe member 20, and thus to the showerhead 70, and extends up through the interconnect portion 32. When the interconnect portion 32 is compressed against the spring member 34, the interconnect portion 32 is moved relative the central pipe 38 and the central pipe 38 is effectively extended relative the interconnect portion 32.

Figure 4:
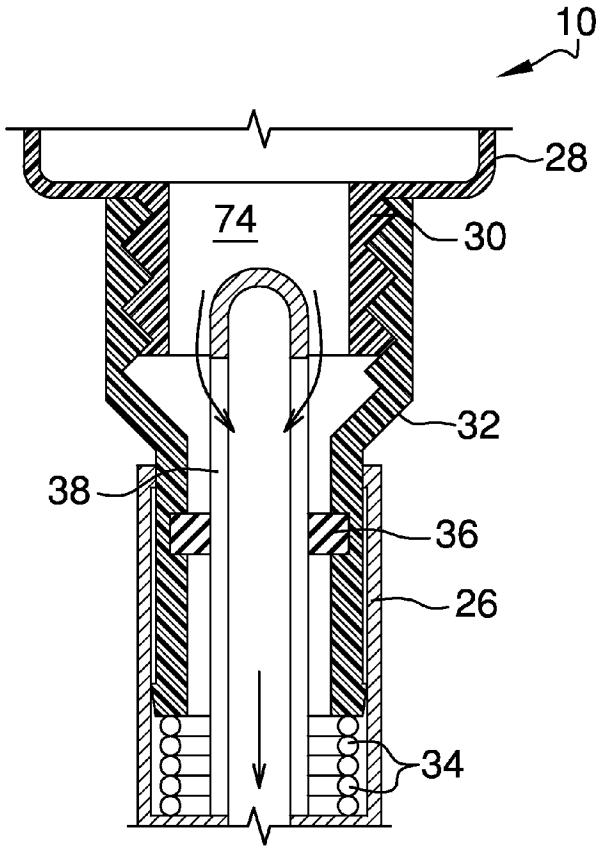
FIG. 4 is a detail cross-section view of an interconnect portion threadably attached to a cartridge.
Figure 3:
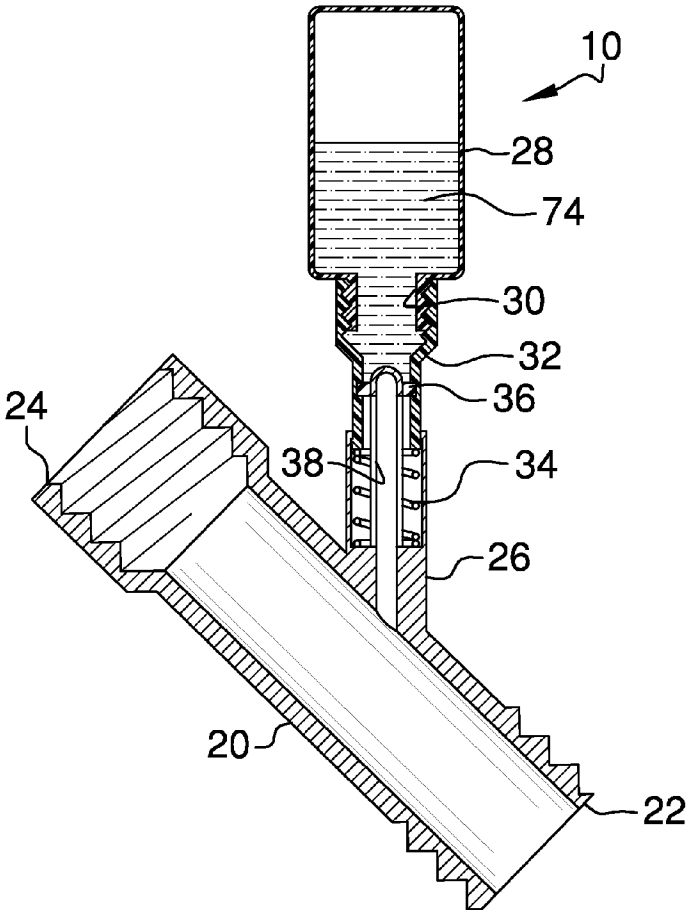
FIG. 3 is a cross-section view taken along the line 3-3 of FIG. 2.
Figure 5:
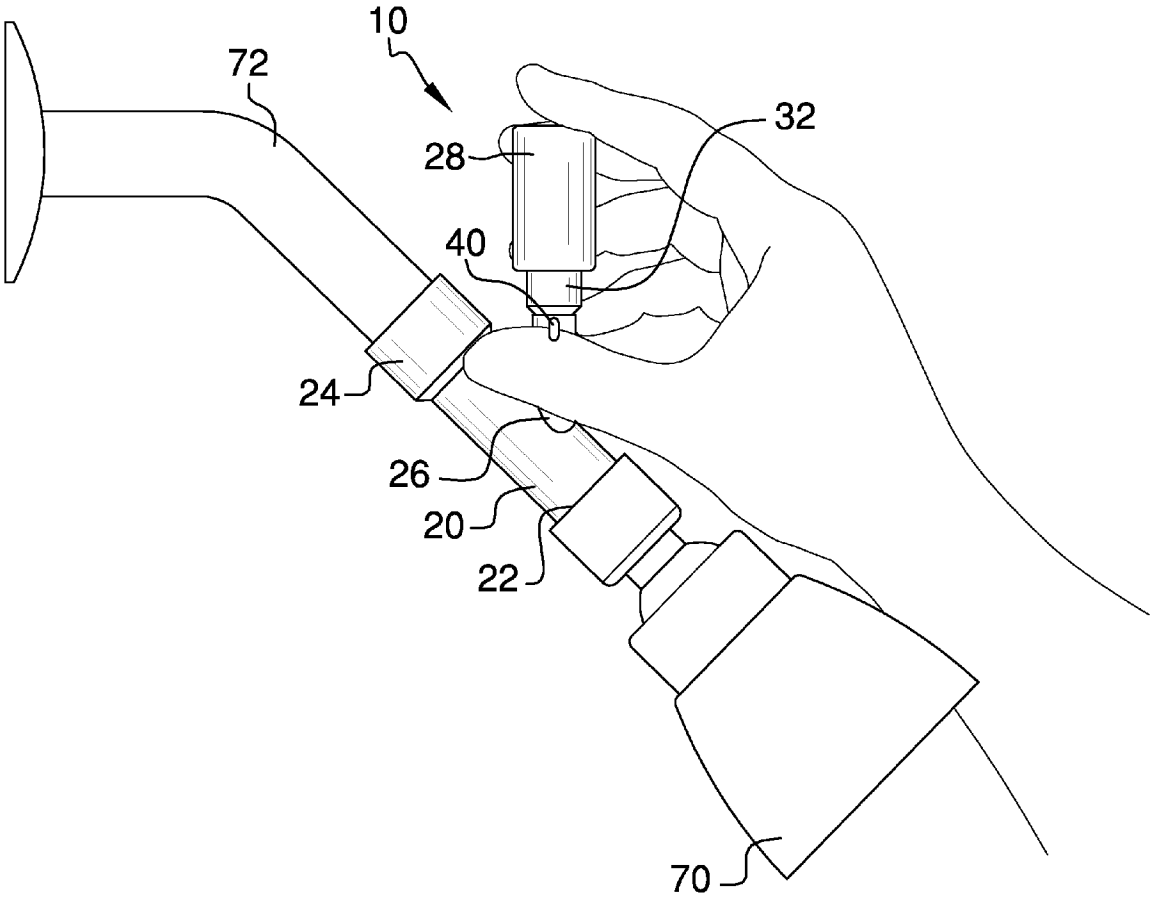
FIG. 5 is an in-use view.

Thus, when the cartridge 28 is attached to the interconnect portion 32 and depressed thereat, the central pipe 38 is effectively extended into the first end 30 of the cartridge 28 whereby the contents of the cartridge 28 are discharged through the central pipe 38 (see FIGS. 3 and 4). When the cartridge 28 is released, and the interconnect portion 32 is returned to the uncompressed position by the action of the spring member 34, the central pipe 38 is effectively retracted from the cartridge 28 first end 30 and cleaning solution 74 ceases to be discharged from the cartridge 28.

To enable leverage against which to depress the cartridge 28, for ease and comfort of use thereby, a pair of thumb supports 40 is disposed upon the side inlet pipe valve 26, there positioned appropriate for grasping by a thumb of a user when singlehandedly depressing the cartridge 28. Each of said pair of thumb supports 40 is disposed for use with each thumb of a user, as desired, when cleaning the showerhead with either hand (see FIG. 5).

The side inlet pipe valve 26 controls directional flow of cleaning solution 74 from the cartridge 28 through to the showerhead 70, and prevents back flow therethrough, Thusly, an extant showerhead 70 is readily, expediently, and efficiently cleanable, sanitized, and disinfected, when said cartridge 28 is attached to the side inlet pipe valve 26 and there depressed.

What is claimed is:

1. A showerhead cleaning adapter comprising a pipe member having a male end and a female end disposed for positioning between an extant showerhead and an extant manifold, said pipe member including a side inlet pipe valve disposed to releasably interconnect a cartridge therein, said cartridge discharging cleaning solution into said showerhead when depressed against a spring member disposed interior to the inlet pipe valve, wherein cleaning solution is selectively releasable to clean and disinfect an extant showerhead interior.

2. The showerhead cleaning adapter of claim 1 wherein the inlet pipe valve further comprises an interconnect portion disposed to threadably secure to the cartridge, said interconnect portion compressibly disposed to interconnect with the cartridge and thence discharge cleaning solution from the cartridge when the cartridge is depressed.

3. The showerhead cleaning adapter of claim 2 wherein the pipe inlet valve includes a spring member disposed interiorly to compressibly engage against the interconnect portion whereby the interconnect portion is returned to a uncompressed position when released subsequent compression.

4. The showerhead cleaning adapter of claim 3 further comprising a central pipe disposed within the side inlet pipe valve, said central pipe maintaining a continuous cavity through the pipe member to the showerhead, said central pipe disposed to discharge cleaning solution from a first end of the cartridge when said cartridge is depressed, wherein the interconnect portion moves relative said central pipe whereby the central pipe is effectively extended into the cartridge first end when the interconnect portion is compressed and said central pipe is effectively retracted therefrom when the interconnect portion is returned to the uncompressed position.

5. The showerhead cleaning adapter of claim 4 wherein cleaning solution is discharged from the cartridge when the central pipe breeches the cartridge first end and said cleaning solution is ceased to discharge from the cartridge when said central pipe is effectively retracted from the cartridge first end.

6. The showerhead cleaning adapter of claim 5 wherein a washer is disposed within the pipe inlet valve to sealably maintain interconnection between the interconnect portion and the cartridge when attached.

7. The showerhead cleaning adapter of claim 6 wherein the pipe inlet valve directionally controls flow from the cartridge into the extant showerhead and prevents backflow therethrough.

8. The showerhead cleaning adapter of claim 7 further comprising a pair of thumb supports disposed upon the side inlet pipe valve and positioned appropriate to provide leverage when a user singlehandedly depresses the cartridge to discharge cleaning solution, each of said pair of thumb supports disposed for use with the thumb of either hand when used to singlehandedly discharge said cleaning solution.

9. A showerhead cleaning adapter comprising:

a pipe member disposed for installation between an extant showerhead and an extant manifold, said showerhead including:

a male threaded end disposed for interconnection with an extant showerhead;

a female end disposed for interconnection with an extant shower pipe manifold;

an attachable cartridge having a threaded first end;

a side inlet pipe valve threadably connectable to the cartridge first end, said side inlet pipe valve comprising:

a compressible interconnect portion disposed to threadably interconnect with the cartridge first end, said cartridge depressible therein;

a spring member compressibly engaged against the interconnect portion, said spring member forcing said interconnect portion back to an uncompressed position when said interconnect portion is released subsequent depression of the cartridge;

a washer disposed to maintain a sealed connection between the cartridge and the interconnect portion when the interconnect portion is in the uncompressed position;

a central pipe immovably disposed within the side inlet pipe valve extending a continuous cavity through the pipe member to the showerhead, said central pipe disposed to breech the first end of the cartridge when the interconnect portion is compressed, and effectively retract from said first end when the interconnect portion is returned to the uncompressed position; and a pair of thumb supports disposed upon the side inlet pipe valve positioned appropriate for grasping by a thumb of a user when singlehandedly depressing the cartridge, each of said pair of thumb supports disposed for use with each thumb of a user;

wherein the side inlet pipe valve controls directional flow of cleaning solution from the cartridge through to the showerhead, and prevents back flow therethrough, whereby an extant showerhead is readily cleanable and disinfected when said cartridge is attached to the side inlet pipe valve and there depressed.

* * * * *